United States Patent [19]

Purdy

[11] Patent Number: 4,511,015

[45] Date of Patent: Apr. 16, 1985

[54] MANLIFT

[76] Inventor: Paul J. Purdy, 608 Morningside Dr., Trenton, Mo. 64683

[21] Appl. No.: 504,429

[22] Filed: Jun. 15, 1983

[51] Int. Cl.[3] ..... B66F 11/04

[52] U.S. Cl. ..... 182/2

[58] Field of Search ..... 182/2, 63

[56] References Cited

U.S. PATENT DOCUMENTS

| | | | |
|---|---|---|---|
| 2,996,141 | 8/1961 | Eitel | 182/2 |
| 3,179,267 | 4/1965 | Bliss | 182/2 |
| 3,224,528 | 12/1965 | Hubbard | 182/2 |
| 3,767,007 | 10/1973 | Garnett | 182/2 |
| 3,826,334 | 7/1974 | Spillman | 182/2 |
| 4,088,200 | 5/1978 | Cowley | 182/2 |
| 4,133,411 | 1/1979 | Curb | 182/2 |
| 4,280,589 | 7/1981 | Merrick | 182/2 |

FOREIGN PATENT DOCUMENTS

| | | | |
|---|---|---|---|
| 1030768 | 10/1956 | Fed. Rep. of Germany | 182/2 |

*Primary Examiner*—Reinaldo P. Machado

*Attorney, Agent, or Firm*—Keil & Weinkauf

[57] ABSTRACT

A manlift having improved stability and safety. A telescoping vertical mast driven by a package of integrally attached cylinders is attached to a rotating base plate slightly offset from the center line of rotation of the base plate. The direction of offset is in the direction opposite to the position of the aerial platform. The manlift also includes a novel arrangement for straddle-mounting the boom, whereby the weight of the cylinders driving the boom through its arc tends to counterbalance the platform. The straddle-mount also allows optimum working height while maintaining low travelling height in the vehicle.

4 Claims, 7 Drawing Figures

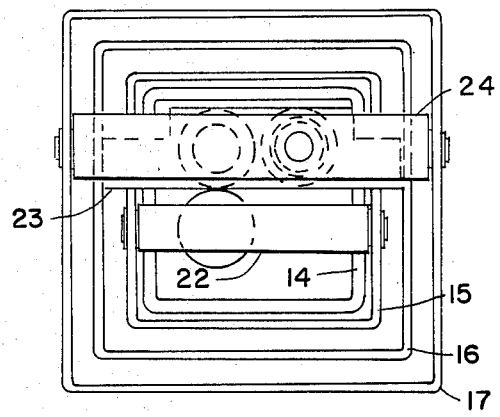
FIG. 2
FIG. 3
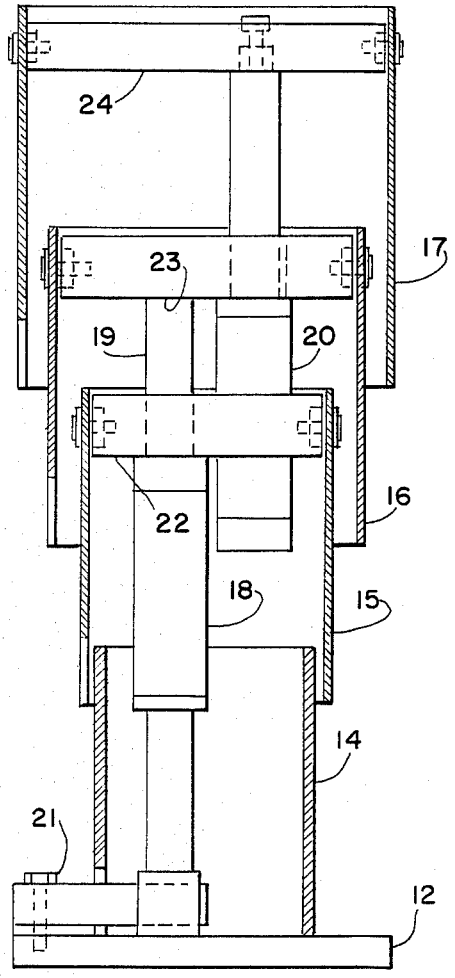
FIG. 4
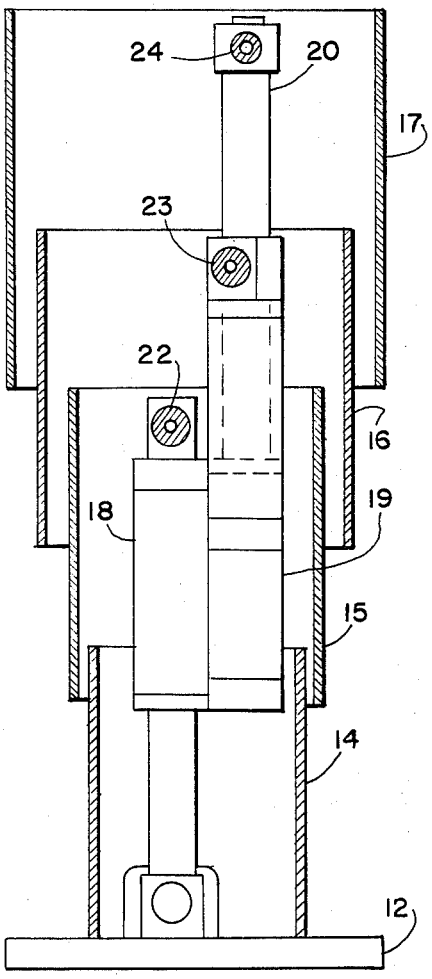

MANLIFT

The invention relates to a manlift having improved stability. The manlift is mounted on a mobile base and consists of multiple, telescoping vertical mast sections, a telescoping articulating boom, and an aerial platform.

Manlifts are used for a variety of purposes, such as repairs, construction, or other operations where it is necessary to elevate a worker. Many devices of this type are known in the prior art. U.S. Pat. No. 4,280,589 discloses a device having a multi-part mast and an extensible boom, all of these parts being operated by hydraulic cylinders. U.S. Pat. No. 4,133,411 teaches an extensible boom mounted on a moveable vehicle base. In U.S. Pat. No. 3,767,007, an extendable ladder is mounted on a turret. A method of driving a rotatable base plate by cylinders and a sprocket is shown in U.S. Pat. No. 3,179,267.

SUMMARY OF THE INVENTION

The present invention is directed to a manlift having increased stability at the extended position, while maintaining a low travel height in the relaxed position. The objective of increased stability and low travel height is achieved by operating the vertical mast sections with a package of integrally attached hydraulic cylinders located within the innermost section of the telescoping mast. The need for travelling chains or hoses to operate the mast is eliminated. The objective of the invention is further realized by mounting the extendable boom on the mast in a straddling manner. The heavy cylinders actuating the boom assembly are located substantially behind the mast, and their weight serves to counterbalance the weight of the extended boom and platform and thus stabilize the vehicle. This straddle connection also allows the full height of the mast assembly to be used to house the telescoping mast sections without interference from the straddle boom.

A further benefit of the present invention is that the cylinder package which operates the mast can be removed without disassembly of the mast.

DESCRIPTION OF THE DRAWINGS

FIG. 2 is a cut-away top view of the telescoping, vertical mast assembly;

FIGS. 3 and 4 are cut-away side viewsof the mast assembly and the cylinder package therein;

DESCRIPTION OF THE PREFERRED EMBODIMENT

Figure 1:
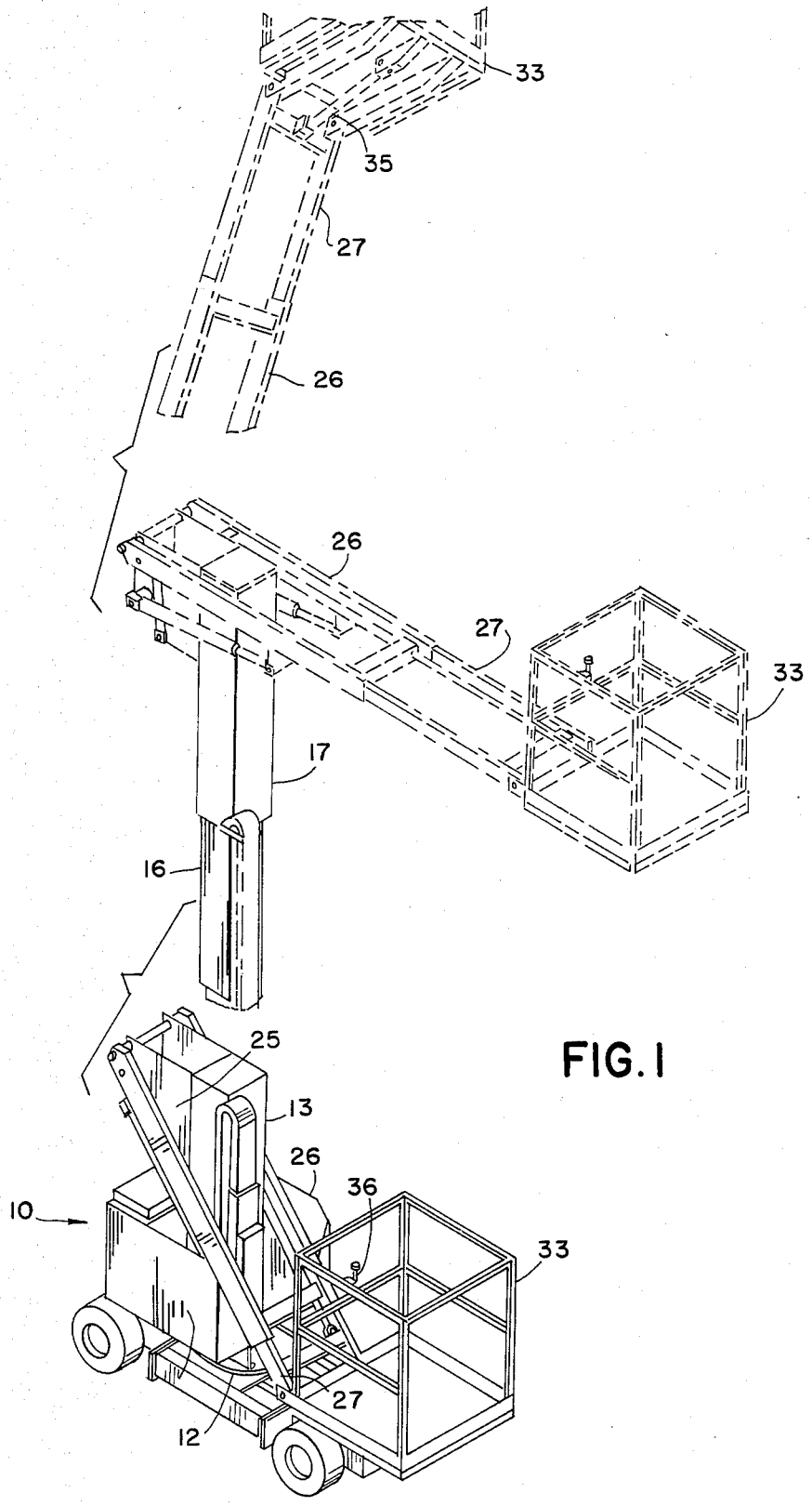
FIG. 1 is a perspective view of the entire man-lift vehicle in relaxed, partially extended, and fully extended positions.

Referring to the drawings, FIG. 1 depicts a mobile manlift 10 comprising a wheeled chassis 11, a rotating base plate 12, and a mast assembly 13 rigidly attached to the base plate. Boom supports 25 extend rearwardly from mast 13, and outer-boom 26 is attached to the supports so as to straddle the mast without contacting it on either side. Aerial platform 33 is pivotally attached to inner-boom 27. Control box 36 operates the cylinders hereinafter described.

The base plate 12 is rotated by cylinders and a sprocket (not shown), which are located on the underside of the vehicle, and are known in the art. In the preferred embodiment, wear resistant, low-friction wear pads are inserted under the base plate. The mast assembly 13 is attached to base plate 12 so as to be slightly offset from the center line of rotation of the base plate. The direction of offset is in the opposite direction from the position of the aerial platform 33. In this manner, the weight of the mast tends to counterbalance the weight of the aerial platform, giving increased stability.

Referring to FIG. 2, the vertical mast assembly consists of four telescoping tube sections 14, 15, 16, and 17. Section 14, the innermost section, is bolted rigidly to the base plate slightly offset from the center line of rotation.

Referring to FIGS. 3 and 4, the mast sections are driven by the cylinder package consisting of hydraulic cylinders 18, 19, and 20. Cylinders 18, 19, and 20 drive mast sections 15, 16, and 17, respectively. Cylinders 18, 19, and 20 are integrally attached to each other to form a cylinder package and are internally ported within the mast. The cylinder 18, and thus the entire cylinder package, is attached to the base plate by pin 21. The cylinders connect to the respective mast sections by means of trunnions 22, 23, and 24. The use of this cylinder package to drive the mast sections eliminates the need for travelling hoses or chains of any type. Further, removal of the cylinder package from the mast is easily accomplished. By removing the trunnion buttons holding trunnions 22, 23, and 24 to the mast, and by removing pin 21, the entire cylinder package can be taken out without disassembly of the mast. In the preferred embodiment, the cylinder package includes an integral holding valve (not shown) to hold up the mast assembly in the event of hydraulic line failure.

Figure 7:
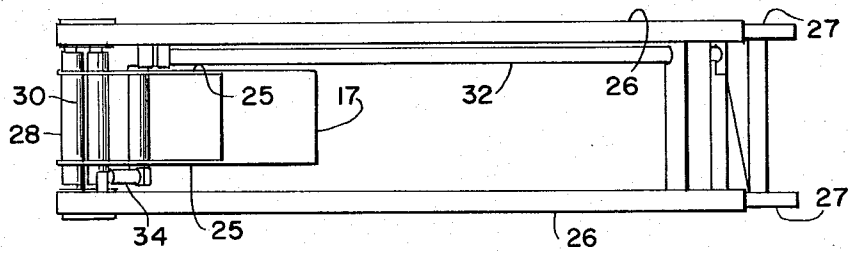
FIG. 7 is a top view of the mast and boom assembly.
Figure 6:
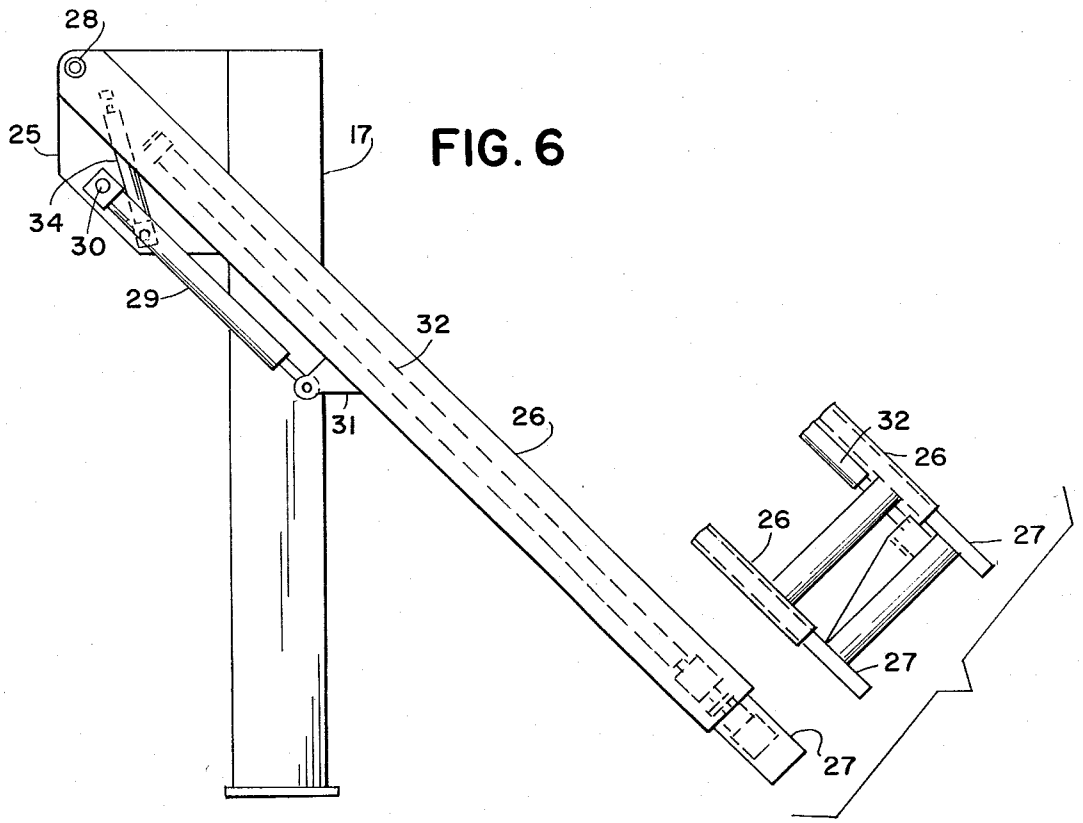
FIG. 6 is a side view of the mast and boom assembly.
Figure 5:
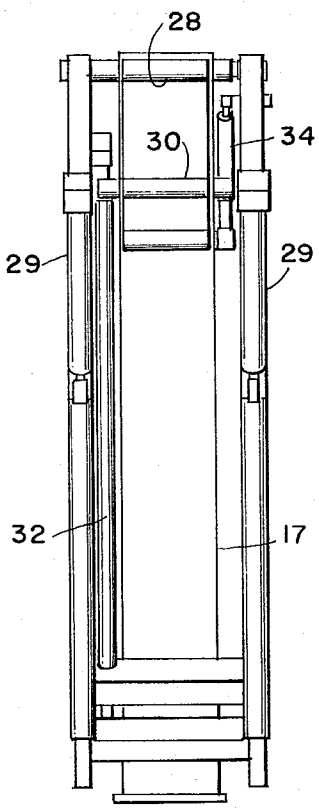
FIG. 5 is a rear view of the mast and boom assembly.

Referring now to FIGS. 5, 6, and 7, outermost mast section 17 has integrally attached thereto boom supports 25. Boom supports 25 are connected to the mast section 17 near its top and extend rearwardly therefrom. The boom assembly consists of outer-boom 26 and inner-boom 27. The outerboom 26 is pivotally connected to the boom supports 25 by trunnion 28. In this manner, the outer-boom 26 straddles the mast. One leg of the boom extends from behind the mast along side of the mast without contacting it, while the other leg extends likewise on the opposite side of the mast. The boom assembly is articulated through its lower to upper positions by lift cylinder 29 on each side. Lift cylinders 29 are attached to the boom supports 25 by trunnion 30 and to flanges 31 on the underside of the outer-boom 26. The fact that two lifting cylinders 29 are used contributes added rigidity to the articulating boom assembly.

The inner-boom assembly 27 is telescoped in and out with respect to the outer-boom 26 by extension cylinder 32. Platform assembly 33 is pivotally connected to the inner-boom 27. The platform assembly 33 is maintained in level position with respect to the ground by master cylinder/slave cylinder leveling system. Mast cylinder 34 is located on one side of the boom and is attached to the outer boom 26 and to the boom support 25. The slave cylinder 35 is connected from a crossbar on the inner-boom to a point on the bottom of the platform assembly 33. The master/slave leveling system is designed such that as the boom assembly is moved through its working arc, the master cylinder is driven by the boom assembly and transfers the proper amount of oil to the slave cylinder to maintain a level platform position throughout the working range.

In the preferred embodiment, lift cylinders 29, extension cylinder 32, and slave cylinder 35 have holding valves (not shown) attached to the cylinders to prevent the lift from falling in the event of hydraulic line failure. In the preferred embodiment, wear pads (not shown) are utilized in the boom and the mast to reduce wear.

The foregoing description is of a man-lift vehicle having improved stability. The stablizing counterweight is provided by three features of the invention. Firstly, the vertical mast assembly is offset slightly from the center line of rotation of the base plate in a direction opposite from the platform assembly. Secondly, the cylinder package operating the mast sections is located within the lower mast section, and its weight serves as a counterbalancing force behind the center line of rotation on the base plate. Thirdly, the boom assembly is connected to the mast in a straddling fashion, such that the heavy actuating cylinders operating the boom are substantially on the opposite side of the mast from the platform assembly. The combination of the vertical mast offset and the straddle boom mount allows a lighter vehicle to meet applicable stability requirements because the heavy vehicle mast section, mast cylinders, and articulating and extension cylinders are located so that they act as a counterweight to help stabilize the vehicle.

The preferred embodiment described above is used as an illustration and is not intended as a limitation on the scope of the invention.

I claim:

1. In a manlift apparatus of the type including a wheeled chassis, a vertical mast, a telescoping boom, and an aerial platform, the improvements comprising:

a fully hydraulic, telescoping, vertical mast, mounted on a rotating base plate on the wheeled chassis slightly offset from the center line of rotation of said base plate;

said fully hydraulic mast including at least two telescoping sections driven to reciprocate by a package of plural equal area cylinders, integrally attached to each other and attached to said telescoping sections, said package of cylinders located within the innermost telescoping section so as to be removable therefrom without disassembly of said telescoping sections; and a telescoping boom mounted to one side of the uppermost section of the vertical mast and extending beyond the other side of said mast in a straddling manner to the aerial platform, said telescoping boom being operated by cylinders located substantially on the said one side of said vertical mast opposite from the aerial platform.

2. The apparatus of claim 1, wherein said vertical mast consists of four telescoping sections driven by three integrally-attached hydraulic cylinders.

3. The manlift of claim 1, wherein the said mast is attached to the said rotating base plate slightly offset from the center line of rotation of the base plate in a direction opposite to the position of the aerial platform, the weight of said cylinder package thereby tending to stabilize said aerial platform.

4. The manlift of claim 1, wherein the said boom is cylinder-driven through its working arc by cylinders which are located substantially at said one side of said mast opposite the aerial platform, thus tending to stabilize said aerial platform.

* * * * *